US008862049B2

(12) United States Patent
Arcidiacono

(10) Patent No.: US 8,862,049 B2
(45) Date of Patent: Oct. 14, 2014

(54) INSTALLATION FOR EMISSION/RECEPTION OF SATELLITE SIGNALS

(75) Inventor: Antonio Arcidiacono, Paris (FR)

(73) Assignee: Eutelsat S A, Paris (FR)

( * ) Notice: Subject to any disclaimer, the term of this patent is extended or adjusted under 35 U.S.C. 154(b) by 264 days.

(21) Appl. No.: 13/518,496

(22) PCT Filed: Dec. 21, 2010

(86) PCT No.: PCT/EP2010/070380

§ 371 (c)(1),
(2), (4) Date: Jul. 27, 2012

(87) PCT Pub. No.: WO2011/076791

PCT Pub. Date: Jun. 30, 2011

(65) Prior Publication Data

US 2012/0282854 A1 Nov. 8, 2012

(30) Foreign Application Priority Data

Dec. 24, 2009 (FR) ..... 09 59574

(51) Int. Cl.
*H04H 20/71* (2008.01)
*H04H 40/90* (2008.01)

(52) U.S. Cl.
CPC ..... *H04H 40/90* (2013.01); *H04H 2201/33* (2013.01)
USPC ..... 455/3.05; 342/361

(58) Field of Classification Search
USPC ..... 455/3.05, 3.02, 3.06, 12.1
See application file for complete search history.

(56) References Cited

U.S. PATENT DOCUMENTS

2006/0274208 A1 * 12/2006 Pedlow, Jr. ..... 348/572

FOREIGN PATENT DOCUMENTS

| | | |
|---|---|---|
| EP | 0 825 773 A1 | 2/1998 |
| EP | 0 888 690 B1 | 8/2001 |
| EP | 2 180 547 A1 | 4/2010 |
| FR | 2 901 933 | 12/2007 |
| FR | 2 913 285 | 9/2008 |

OTHER PUBLICATIONS

International Search Report as issued for PCT/EP2010/070380.

* cited by examiner

*Primary Examiner* — Tu X Nguyen
(74) *Attorney, Agent, or Firm* — Pillsbury Winthrop Shaw Pittman LLP

(57) ABSTRACT

An emission/reception installation of satellite signals including a reflector to receive and emit radio signals, a unit integrating an LNB to transform radio signals into electrical signals in a first frequency band, to amplify the electrical signals in the first frequency band and to lower the first frequency band towards a first intermediate frequency band. The unit includes an emitter to amplify electrical signals in a second intermediate band having no common frequency with the first intermediate band, to raise the second intermediate band towards a second frequency band, to transform into radio signals the electrical signals in the second frequency band and to transmit these radio signals towards the reflector. The installation includes a box including a modulator to modulate electrical signals in the second intermediate band, an output to transmit electrical signals in the first intermediate band and a coaxial cable connecting the unit and the box.

19 Claims, 1 Drawing Sheet

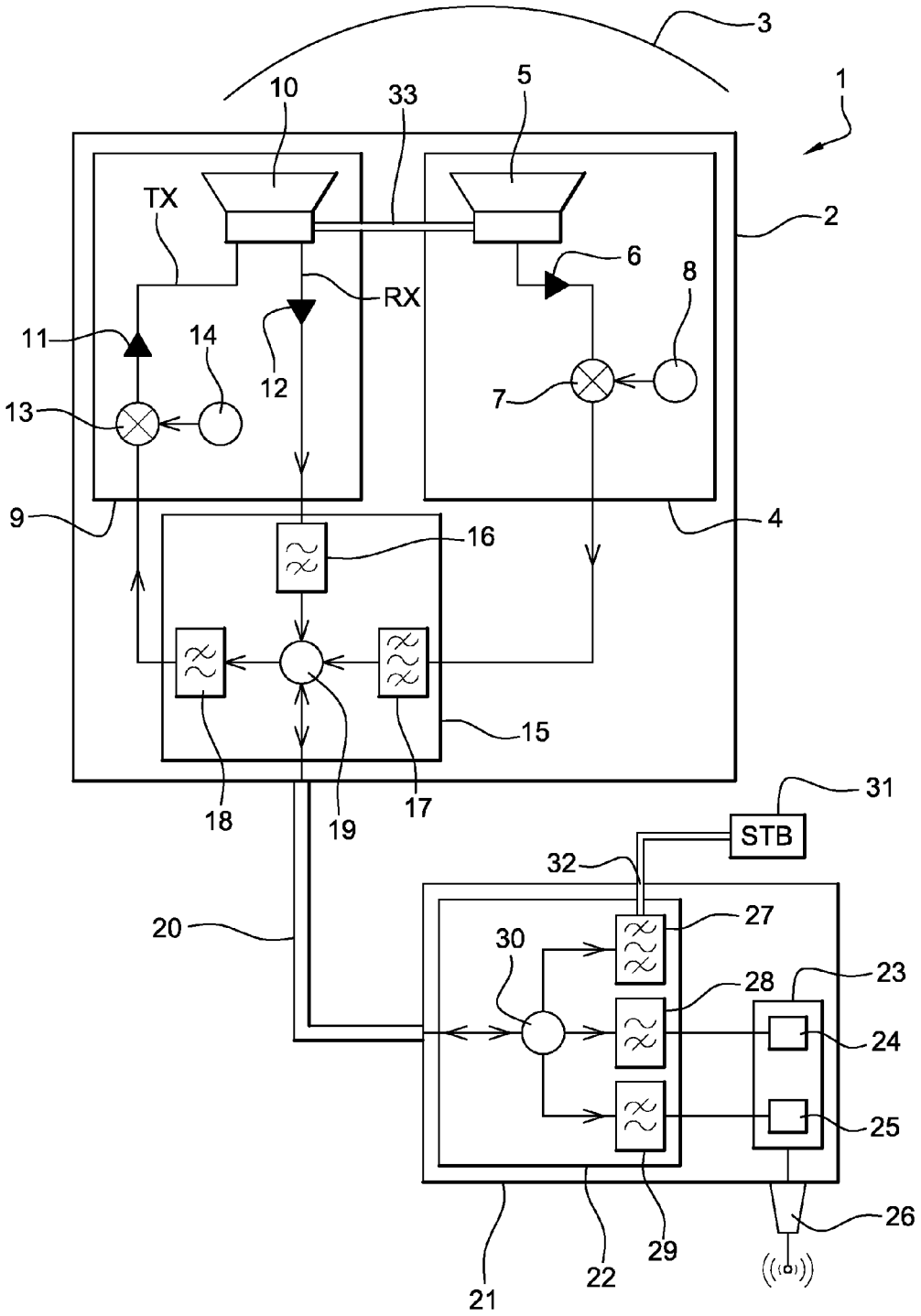
3
1
10
33
5
TX
2
6
8
RX
11
14
12
7
13
9
4
16
15
18
19
17
31
STB
32
20
27
30
28
23
24
25
26
29
22
21

INSTALLATION FOR EMISSION/RECEPTION OF SATELLITE SIGNALS

CROSS REFERENCE TO RELATED APPLICATIONS

This application is the U.S. National Stage of PCT/EP2010/070380, filed Dec. 21, 2010, which in turn claims priority to French Patent Application No. 0959574, filed Dec. 24, 2009, the entire contents of all applications are incorporated herein by reference in their entireties.

The present invention concerns an installation for emission/reception of hyperfrequency radioelectrical satellite signals.

Currently, the broadcast diffusion of television programmes by satellite is widely used throughout the world. Numerous devices are installed at millions of users. The installed devices are predominantly reception devices which comprise an exterior unit including a parabolic reflector which focuses the modulated hyprefrequency signals, on the source, designated a cornet, of an LNB (Low Noise Block, which means a reception block), with the LNB transforming the received hyperfrequency signals into electrical signals in intermediate satellite band so as to transmit them by means of a coaxial cable to an interior unit commonly designated a satellite decoder or else STB (Set Top Box). The decoder comprises a demodulation block which extracts a "useful" modulated signal in the modulated signal transmitted on the coaxial cable and demodulates the extracted "useful" signal. The demodulated "useful" signal can, for example, be used for the display of video images on a television screen.

Today, satellite operators essentially offer services for the transport of television channels, these services being purely passive, i.e. a one-way service.

It can, however, prove useful to be able to offer services requiring a return link; this is the case, for example, in interactive services (votes, consumption of contents with conditional access by key exchange, orders for new services such as video on demand). More generally, this return link can find particularly interesting applications in the field of machine-to-machine communications or M2M to control certain equipment (alarm, heating, . . . ) present within the home.

The majority of satellite television services which are offered do not integrate a return link, with the exception of services such as the Tooway™ service which constitutes a bidirectional high-speed access service to the internet by satellite based for example on the SurfBeam™ DOCSIS™ technology. A service such as the Tooway™ service can, however, equip a limited number of users and, moreover, requires bulky equipment which is difficult to install (heavy antenna supports, the obligation to add a second antenna or to replace the existing antenna and the passing of one or two additional coaxial cables).

Another example of a bidirectional satellite television diffusion system is described in the patent document EP0888690; this system uses a broadband forward link Ku and a narrowband return link L. Again, this system is cumbersome, complex and costly in that it requires the presence of two reflectors (for each band Ku and L) or of one dedicated reflector comprising a reflector suited to receive Ku band signals and integrating a band L transmission antenna. This system also involves the presence of two physical paths for the routing of data, one from the Ku band antenna towards the decoder inside the house and the other from the decoder towards the L band antenna. It will be readily understood that this type of installation involves a complete change of the standard systems currently equipping households and a not inconsiderable additional cost.

Another solution consists in using a return link using a connection of the ADSL type provided by fixed telephony operators (STN or "Switched Telephone Network") or a connection of the GPRS/UMTS type provided by mobile telephony operators. This solution therefore necessitates considerable and costly supplementary equipment and also an additional subscription; furthermore, the telephonic switching is not particularly suited to the transmission of smaller messages such as voting or command messages.

In this context, the present invention aims to provide an installation for the emission/reception of hyperfrequency radioelectrical satellite signals which is efficient in terms of performance, is also very easily adaptable to a pre-existing installation, is low in cost and is particularly suited to M2M applications.

To this end, the invention proposes an installation for the emission/reception of hyperfrequency radioelectrical satellite signals comprising:

- a reflector suited to receive and emit hyperfrequency radioelectrical signals;
- an emission/reception unit integrating a low noise block LNB down converter suited to:
  - transform radioelectrical signals into electrical signals in a first frequency band greater than 10 GHz concentrated by the reflector;
  - amplify the electrical signals in the first frequency band;
  - lower the frequency band towards a first intermediate frequency band;

the said installation being characterized in that the emission/reception unit further comprises an emitter suited to:

- amplify electrical signals;
- raise a second intermediate frequency band having no common frequency with the first intermediate frequency band towards a second frequency band;
- transform into radioelectrical signals the electrical signals in the second frequency band;
- transmit the radioelectrical signals in the second frequency band towards the reflector;

the said installation further comprising:

- a box including:
  - a modulator suited to modulate electrical signals in the second intermediate frequency band;
  - an output suited to transmit towards a decoder electrical signals in the first intermediate frequency band;
- a coaxial cable connecting the emission/reception unit and the box suited to:
  - convey the electrical signals in the second intermediate frequency band from the box towards the emission/reception unit;
  - convey the electrical signals in the first intermediate frequency band from the emission/reception unit towards the box.

Owing to the invention, advantageously the gain of the reflector used to receive the hyperfrequency signals in the first band (for example the Ku or Ka band) is used to transmit the return link signals in the second frequency band for example comprised between 1.5 and 5 GHz (i.e. the frequencies of band S). The gain of the reflector allows one to avoid using too powerful an amplifier in the return link; typically, an amplifier of the solid state type SSPA (Solid State Power Amplifier) amplifying signals at 100 mW such as the WiFi signal amplifiers currently available on the market could be used. It will be noted that conversely in the terminals currently emitting in band S, the fact of using a small omnidirectional antenna entails the use of a high power amplifier (i.e. in the order of 1 W to several W).

The emission/reception installation according to the invention can also have one or more of the following characteristics, considered individually or according to all the technically possible combinations:

- the frequency band greater than 10 GHz is the Ku band or the Ka band;
- the second frequency band is the band [1980 MHz; 2010 MHz];
- the first intermediate frequency band is comprised between 950 and 2150 MHz and the second intermediate frequency band has an upper limit of less than 450 MHz;
- the emission/reception unit integrates a receiver suited to:
  - transform into electrical signals hyperfrequency signals in a third frequency band (for example comprised between 1.5 and 5 GHz (i.e. the frequencies of band S)) concentrated by the reflector;
  - amplify the said electrical signals in the third frequency band;

the said box comprising a demodulator suited to demodulate electrical signals in the said third frequency band and the said coaxial cable connecting the emission/reception unit and the box being suited to convey the electrical signals in the third frequency band from the emission/reception unit towards the box.

- the third frequency band is the band [2170 MHz; 2200 MHz];
- the said demodulator is suited to demodulate signals modulated according to the DVB-SH standard;
- the said emitter and the said receiver are integrated within the same emission/reception block;
- the said emission/reception block is made integral with the said LNB convertor via an addition device of the said emission/reception block to the said LNB converter;
- the said emission/reception unit comprises:
  - a first filter suited to allow the passage of the electrical signals in the second intermediate frequency band and to filter the electrical signals in the first intermediate frequency band and in the third frequency band, the output of the said first filter being suited to transmit electrical signals towards the said emitter and the input of the said first filter being suited to receive electrical signals transmitted by the coaxial cable;
  - a second filter suited to allow the passage of the electrical signals in the first intermediate frequency band and to filter the electrical signals in the second intermediate frequency band and in the third frequency band, the input of the said second filter being suited to receive electrical signals transmitted by the said LNB converter and the output of the said second filter being suited to transmit electrical signals towards the coaxial cable;
  - a third filter suited to allow the passage of the electrical signals in the third frequency band and to filter the electrical signals in the first intermediate frequency band and in the second intermediate frequency band, the input of the said third filter being suited to receive electrical signals transmitted by the said receiver and the output of the said third filter being suited to transmit electrical signals towards the coaxial cable.
- the said first filter is a low-pass filter;
- the said second filter is a band-pass filter;
- the said third filter is a high-pass filter;
- the said box comprises:
  - a fourth filter suited to allow the passage of the electrical signals in the second intermediate frequency band and to filter the electrical signals in the first intermediate frequency band and in the third frequency band, the input of the said fourth filter being suited to receive electrical signals transmitted by the said modulator and the output of the said fourth filter being suited to transmit electrical signals towards the coaxial cable;
  - a fifth filter suited to allow the passage of the electrical signals in the first intermediate frequency band and to filter the electrical signals in the second intermediate frequency band and in the third frequency band, the output of the said fifth filter being suited to transmit electrical signals towards a decoder and the input of the said fifth filter being suited to receive electrical signals transmitted by the coaxial cable;
  - a sixth filter suited to allow the passage of the electrical signals in the third frequency band and to filter the electrical signals in the first intermediate frequency band and in the second intermediate frequency band, the output of the said sixth filter being suited to transmit electrical signals towards the demodulator and the input of the said sixth filter being suited to receive electrical signals transmitted by the coaxial cable;
- the said fourth filter is a low-pass filter;
- the said fifth filter is a band-pass filter;
- the said sixth filter is a high-pass filter;
- the said box comprises wireless connection means such as WiFi, WiMax, BlueTooth, ZigBee or KNX means;
- the said wireless connection means are suited to emit data demodulated by the said demodulator and to receive data to be transmitted to the said modulator;
- the amplification means used in the emitter are formed by a solid state SSPA amplifier amplifying at a power less than 500 mW and preferably less than 200 mW;
- the amplification means of the electrical signals used in the emitter are suited to amplify electrical signals in the said second intermediate frequency band (the amplification means of the SSPA type are therefore situated before the frequency converter allowing the second intermediate frequency band to be raised towards the second frequency band);
- the amplification means of the electrical signals used in the emitter are suited to amplify electrical signals in the said second frequency band (the amplification means of the SSPA type are therefore situated after the frequency converter allowing the second intermediate frequency band to be raised towards the second frequency band).

The single FIG. 1 represents diagrammatically an emission/reception installation 1 according to the invention.

The emission/reception installation 1 comprises:

- a parabolic reflector 3;
- an emission/reception unit 2 exterior to the house;
- a coaxial cable 20;
- a box 21 intended to be housed inside the house.

The parabolic reflector 3 receives signals issued from a satellite in band Ku (band 10.7 GHz-12.75 GHz) corresponding to an orbital position at 13° East and from a satellite in band S (band 2170 MHz-2200 MHz) corresponding to an orbital position at 10° East; it will be noted that the information concerning the orbital positions of the satellites and the frequencies used are given purely by way of illustration and in a non-restrictive manner.

The emission/reception unit 2 comprises:

an LNB block 4;

an emission/reception block 9;

a multiplexer 15 of radioelectrical signals.

Generally, the modulated signal received by the LNB block 4 has an initial frequency band which extends for example between 10.7 GHz and 12.75 GHz, which corresponds to the Ku frequency band used for the transmission of signals between a satellite and a receiving station on the ground. This band is separated by the LNB block 4 and a low band from 10.7 GHz to 11.7 GHz and a high band from 11.7 GH to 12.75 GHz. Each band, low or high, is divided into frequency channels, the frequency band of each modulated "useful" signal being comprised in one of the frequency channels.

This LNB 4 is, moreover, designed to allow the reception of polarisation signals. The polarisation can be, for example, rectilinear (horizontal or vertical), or else circular (right or left).

For the sake of simplification, the LNB 4 as described below will only deal with a frequency band (for example the band 11.7 GHz to 12.75 GHz) for a single polarisation.

The LNB block 4 incorporates:

a cornet 5 for the reception of hyperfrequency radioelectrical signals emitted by the satellite in band Ku and concentrated by the reflector 3;

a low noise amplifier 6 to amplify the electrical signal representative of the radioelectrical wave received in band Ku (designated first frequency band) and originating from the cornet 5.

a local oscillator 8 generating a transposition signal at an oscillation-frequency of 10.6 GHz;

a frequency mixer 7 having a first input to receive the signal amplified by the low noise amplifier 6 and a second input to receive the signal generated by the local oscillator 8 such that it produces an electrical signal in a first intermediate frequency band from 1100 MHz to 2150 MHz.

The LNB block 4 also comprises an antenna point to transform the wave received according to a polarisation in band Ku into an electrical signal.

The emission/reception block 9 integrates a transmit path TX and a receive path RX.

More specifically, the emission/reception block 9 comprises a cornet 10 provided with a point, not shown, suited to transform electrical emission signals in band S (for example in the band [1980 MHz-2010 MHz]), designated second frequency band, into hyperfrequency radioelectrical signals transmitted towards the reflector 3; the cornet 10 is also suited for the reception of hyperfrequency radioelectrical transmission signals emitted by the satellite in band S (for example in the band [2170 MHz-2200 MHz]), designated the third frequency band, and concentrated by the reflector 3;

a low noise amplifier 12 to amplify the representative electrical signal of the radioelectrical wave received in reception band S (third frequency band) and originating from the cornet 10;

an amplifier of the solid state type 11 or SSPA (Solid State Power Amplifier), suited to amplify an electrical signal in the second frequency band [1980 MHz-2010 MHz] at a power approximately equal to 100 mW then to transmit this amplified signal towards the reflector 3.

a local oscillator 14 generating a transposition signal at an oscillation frequency of 1610 MHz;

a frequency mixer 13 having a first input to receive electrical signals in a second intermediate frequency band (for example the band [370 MHz-400 MHz]) and a second input to receive the signal generated by the local oscillator 14 such that it produces an electrical signal in the second frequency band [1980 MHz-2010 MHz].

The multiplexer 5 comprises:

a low-pass filter 18, the output of which is connected to the input of the frequency mixer 13 and the input is connected to a hyperfrequency coupler 19; the low-pass filter 18 allows the passage here of the frequencies lower than 400 MHz;

a high-pass filter 16, the output of which is connected to the coupler 19 and the input is connected to the output of the low noise amplifier 12; the high-pass filter 16 allows the passage of the frequencies greater than 2170 MHz;

a band-pass filter 17, the output of which is connected to the coupler 19 and the input is connected to the output of the frequency mixer 7; the band-pass filter 17 allows the passage of the frequencies comprised between 1100 MHz and 2150 MHz.

The installation 1 illustrated in FIG. 1 assumes the use of a parabolic reflector 3 receiving the signals issued from satellites in bands Ku corresponding to a given orbital position, typically at 13° East. Insofar as the emission/reception block 9 functions in band S corresponding to an orbital position of the satellite in band S at 10° East, it can prove of interest to use an addition device 33 of the emission/reception block 9 on the LNB 5 of the parabolic receiver already equipped, pointed and regulated without it being necessary to modify the mounting or the regulating of the existing antenna. Such an addition device 33 is described for example in the patent application FR2913285 or in the patent application FR 08/56940 filed on 14 Oct. 2008 by the company EUTELSAT™.

The box 21 comprises:

a demultiplexer 22;

a modem 23 integrating a modulator 25 and a demodulator 24;

wireless connection means 26 to a local network of the WiFi, WiMax, BlueTooth, ZigBee or KNX type;

an output 32 suited to deliver signals towards a satellite decoder 31, also designated an STB (Set Top Box).

The demultiplexer 22 comprises:

a low-pass filter 29, the output of which is connected to a hyperfrequency coupler 30 and the input is connected to the output of the modulator 25; the low-pass filter 29 allows the passage here of the frequencies lower than 400 MHz;

a high-pass filter 28, the input of which is connected to the coupler 30 and the output is connected to the input of the demodulator 24; the high-pass filter 28 allows the passage of the frequencies greater than 2170 MHz;

a band-pass filter 27, the input of which is connected to the coupler 30 and the output is connected to the output 22 suited to supply the decoder 31; the band-pass filter 27 allows the passage of the frequencies comprised between 1100 MHz and 2150 MHz.

The coaxial cable 20 connects the box 21 via its demultiplexer 22 and the emission/reception unit 2 via its multiplexer 15.

The demodulator 24 is for example a demodulator functioning according to the DVB-SH standard (ETSI EN 302 583 v1.1.0 (2008-1) Digital Video Broadcasting (DVB); Framing structure, channel coding and modulation for Satellite Services to Handled devices (SH) below 3 GHz, January 2008).

The modulator 25 is for example a modulator functioning according to an asynchronous multiple random access protocol of the type SPREAD ALOHA using interference elimination techniques. Such a protocol is described for example in the document "A High Efficiency Scheme for Quasi-Real- Time Satellite Mobile Messaging Systems" (Riccardo De Gaudenzi and Oscar del Rio—27th AIAA International Communications Satellite Systems Conference ICSSC 2009, Edinburgh, Scotland, 1-4 Jun. 2009).

It will be noted that it is also possible to use other types of protocols (the synchronous protocol DAMA "Demand Assigned Multiple Access" for example) for the modulator 25.

The operating principle of the installation 1 according to the invention rests on the use of a reception part (without emission) in band Ku formed by the reflector 3 and the LNB 2 and by an emission/reception part in band S formed by the emission/reception block 9.

All of the signals are multiplexed on the single coaxial cable 20.

The signals received in band S (here the band [2170 MHz-2200 MHz]) are directly transmitted (without modification of frequency) on the coaxial cable 20 by the multiplexer 15 after filtering via the high-pass filter 16 and passing through the hyperfrequency coupler 19. These signals are then recovered at the level of the hyperfrequency coupler 30 of the demultiplexer 22, then filtered through the high-pass filter 28 before being transmitted to the demodulator DVB-SH 24.

The signals received in band Ku are transmitted by the multiplexer 15 on the coaxial cable 20 after frequency lowering on the first intermediate frequency band (here the band [1100 MHz-2150 MHz]) and filtering through the band-pass filter 17. These signals are then recovered at the level of the hyperfrequency coupler 30 of the demultiplexer 22 then filtered through the band-pass filter 27 before being transmitted to the STB 31 via the output 32.

The signals to be emitted in band S are modulated by the modulator 25 on the second intermediate frequency band (here [370 MHz-400 MHz] given purely by way of illustration) and are transmitted on the coaxial cable 20 by the demultiplexer 22 after having been filtered by the low-pass filter 29. The fact of taking a second intermediate frequency band separate from the first frequency band allows the risks of interference to be avoided between the signals transmitted according to the two intermediate frequency bands. Moreover, the fact of fixing an upper limit less than 450 MHz (here 400 MHz) for the second intermediate frequency band allows the risks of interference to be avoided with the UHF band in the air. The signals to be emitted in band S are for example signals transmitted by a user via the wireless connections 26.

The intermediate frequency bands are, moreover, compatible with the passing band of a standard coaxial cable. It will be noted that an intermediate frequency band is not used for the signals received in band S, the frequency of these latter being directly compatible with the passing band of the cable 20. Even if the installation advantageously uses the band S in emission, the installation according to the invention also allows the use of band S in reception.

The signals received in band Ku are for example television audio/video signals. The installation according to the invention finds a first application of particular interest in the case of interactive television using band S for sending return link messages. Band S allows tens of millions of terminals to be managed in return link sending about one hundred short messages per day.

A second particularly interesting application of the installation according to the invention concerns the field of M2M. In this case, the return link in band S can be used to transmit information originating from an apparatus situated in the house, such as an alarm system; thus, when the alarm system is triggered, a signal is transmitted by the alarm system to the wireless connection means 26 (for example means operating in ZigBee) and a message indicating the actuation of the alarm is transmitted on the return link in band S.

The installation according to the invention can be implemented using an existing installation: thus, it can re-use an existing antenna which is already installed and also the coaxial drop cable, thus limiting considerably the additional costs in terms of equipment and installation.

Of course, the invention is not limited to the embodiment which has just been described.

Thus, the invention has been more particularly described in the case of the band Ku, but it can also be applied to other broadcasting frequency bands such as band Ka.

Likewise, we have described an embodiment specific to the reception of television channels, but the invention can find other applications in the field of M2M; purely by way of illustration, an installation according to the invention can be integrated in street lamps situated on highways; these can then have a surveillance function. For example, all the street lamps which are equipped receive a request (in the first frequency band) asking them to search for a vehicle having a given registration number. Once the vehicle has been identified (by recognition means known to the man skilled in the art) by one of the equipped street lamps, the latter transmits identification information in band S.

It will be noted that the installation according to the invention has been described with wireless connection means, but it can also integrate other types of interface such as an Ethernet or USB connection.

Furthermore, although the invention has been described with reference to the FIGURE for an amplifier of the SSPA type situated after the frequency converter, the invention also applies to an amplifier of the SSPA type, situated before the converter.

Finally, the invention has been presented in the case of a usage in band S, but it can also be used in band C.

The invention claimed is:

1. An emission/reception installation of hyperfrequency radioelectrical satellite signals comprising:

a reflector configured to receive and emit hyperfrequency radioelectrical signals;

an emission/reception unit comprising a low noise block down converter configured to:

transform radioelectrical signals into electrical signals in a first frequency band greater than 10 GHz concentrated by the reflector;

amplify the electrical signals in the first frequency band; and lower the first frequency band towards a first intermediate frequency band; and an emitter configured to:

amplify electrical signals;

raise a second intermediate frequency band having no common frequency with the first intermediate frequency band towards a second frequency band;

transform into radioelectrical signals the electrical signals in the second frequency band;

transmit the radioelectrical signals in the second frequency band towards the reflector;

a box including:

a modulator configured to modulate electrical signals in the second intermediate frequency band;

an output configured to transmit towards a decoder electrical signals in the first intermediate frequency band;

a coaxial cable connecting the emission/reception unit and the box configured to:

convey the electrical signals in the second intermediate frequency band from the box towards the emission/reception unit;

convey the electrical signals in the first intermediate frequency band from the emission/reception unit towards the box.

2. The emission/reception installation according to claim 1, wherein the first frequency band greater than 10 GHz is the Ku band or the Ka band.

3. The emission/reception installation according to claim 1, wherein the second frequency band is the band [1980 MHz; 2010 MHz].

4. The emission/reception installation according to claim 1, wherein the first intermediate frequency band is comprised between 950 and 2150 MHz and the second intermediate frequency band has an upper limit less than 450 MHz.

5. The emission/reception installation according to claim 1, wherein the emission/reception unit comprises a receiver configured to:

transform hyperfrequency signals into electrical signals in a third frequency band concentrated by the reflector;

amplify said electrical signals in the third frequency band;

said box comprising a demodulator configured to demodulate electrical signals in said third frequency band and said coaxial cable connecting the emission/reception unit and the box being configured to convey the electrical signals in the third frequency band from the emission/reception unit towards the box.

6. The emission/reception installation according to claim 5, wherein the third frequency band is the band [2170 MHz; 2200 MHz].

7. The emission/reception installation according to claim 5, wherein said demodulator is configured to demodulate signals modulated according to the DVB-SH standard.

8. The emission/reception installation according to claim 5, wherein said emitter and said receiver are integrated within the same emission/reception block.

9. The emission/reception installation according to claim 8, wherein said emission/reception block is made integral with said low noise block down converter via an addition device of said emission/reception block to said low noise block down converter.

10. The emission/reception installation according to claim 5, wherein said emission/reception unit comprises:

a first filter configured to allow the passage of the electrical signals in the second intermediate frequency band and to filter the electrical signals in the first intermediate frequency band and in the third frequency band, the output of said first filter being configured to transmit electrical signals towards said emitter and the input of said first filter being configured to receive electrical signals transmitted by the coaxial cable;

a second filter configured to allow the passage of the electrical signals in the first intermediate frequency band and to filter the electrical signals in the second intermediate frequency band and in the third frequency band, the input of said second filter being configured to receive electrical signals transmitted by said low noise block down converter and the output of said second filter being configured to transmit electrical signals towards the coaxial cable;

a third filter configured to allow the passage of the electrical signals in the third frequency band and to filter the electrical signals in the first intermediate frequency band and in the second intermediate frequency band, the input of said third filter being configured to receive electrical signals transmitted by said receiver and the output of said third filter being configured to transmit electrical signals towards the coaxial cable.

11. The emission/reception installation according to claim 10, wherein said first filter is a low-pass filter;

said second filter is a band-pass filter;

said third filter is a high-pass filter.

12. The emission/reception installation according to claim 5, wherein said box comprises:

a fourth filter configured to allow the passage of the electrical signals in the second intermediate frequency band and to filter the electrical signals in the first intermediate frequency band and in the third frequency band, the input of said fourth filter being configured to receive electrical signals transmitted by said modulator and the output of said fourth filter being configured to transmit electrical signals towards the coaxial cable;

a fifth filter configured to allow the passage of the electrical signals in the first intermediate frequency band and to filter the electrical signals in the second intermediate frequency band and in the third frequency band, the output of said fifth filter being configured to transmit electrical signals towards a decoder and the input of said fifth filter being configured to receive electrical signals transmitted by the coaxial cable;

a sixth filter configured to allow the passage of the electrical signals in the third frequency band and to filter the electrical signals in the first intermediate frequency band and in the second intermediate frequency band, the output of said sixth filter being configured to transmit electrical signals towards the demodulator and the input of said sixth filter being configured to receive electrical signals transmitted by the coaxial cable.

13. The emission/reception installation according to claim 12, wherein said fourth filter is a low-pass filter;

said fifth filter is a band-pass filter;

said sixth filter is a high-pass filter.

14. The emission/reception installation according to claim 1, wherein said box comprises a wireless connection device such as WiFi, WiMax, BlueTooth, ZigBee or KNX device.

15. The emission/reception installation according to claim 14, wherein said wireless connection device is configured to emit data demodulated by a de-modulator and to receive data to be transmitted to said modulator.

16. The emission/reception installation according to claim 1, wherein an amplifier used in the emitter is formed by a solid state amplifier SSPA amplifying at a power lower than 500 mW.

17. The emission/reception installation according to claim 16, wherein the power is lower than 200 mW.

18. The emission/reception installation according to claim 1, wherein an amplifier of the electrical signals used in the emitter is configured to amplify electrical signals in said second intermediate frequency band.

19. The emission/reception installation according to claim 1, wherein an amplifier of the electrical signals used in the emitter is configured to amplify electrical signals in said second frequency band.

* * * * *